United States Patent [19]

Goller et al.

[11] Patent Number: 4,799,365

[45] Date of Patent: Jan. 24, 1989

[54] DEVICE FOR FLATBED KNITTING MACHINES FOR MONITORING THE KNITWEAR FOR FALLING-OFF

[75] Inventors: Ernest Goller, Reutlingen; Fritz Walker, Kusterdingen, both of Fed. Rep. of Germany

[73] Assignee: H. Stoll GmbH & Co., Reutlingen, Fed. Rep. of Germany

[21] Appl. No.: 168,081

[22] Filed: Mar. 9, 1988

[30] Foreign Application Priority Data

Mar. 10, 1987 [DE] Fed. Rep. of Germany ..... 3707569

[51] Int. Cl.[4] ..... D04B 35/20

[52] U.S. Cl. ..... 66/166

[58] Field of Search ..... 66/166, 167, 157

[56] References Cited

U.S. PATENT DOCUMENTS 2,859,603 11/1958 Edelman et al. ..... 66/166
3,046,767 7/1962 Nickell ..... 66/166
4,565,076 1/1986 Tsuchiya ..... 66/166
4,633,914 1/1987 Carry ..... 66/166

*Primary Examiner*—Ronald Feldbaum
*Attorney, Agent, or Firm*—Larson and Taylor

[57] ABSTRACT

The device for monitoring the knitwear (16') of a flatbed knitting machine for falling-off exhibits several support bodies (18) having in each case a feeling lever (17) which rests against the knitwear (16') and which is coupled to a switching arm (25). The switching arm (25) is constructed as a contactless contactor and is moved during an adjusting movement of the feeling lever (17), which is triggered when knitwear (16') has fallen off, through the contact range of an electric switching device, for example a light barrier or an ultrasonic barrier or through a magnetic field area into an ineffective end position so that a control signal can be triggered only during the adjusting movement of the switching arm (25) between its end positions.

7 Claims, 2 Drawing Sheets

DEVICE FOR FLATBED KNITTING MACHINES FOR MONITORING THE KNITWEAR FOR FALLING-OFF

DESCRIPTION

The invention relates to a device for flatbed knitting machines for monitoring the knitwear for falling-off, having at least one feeling lever which is supported on a support body adjustable in the longitudinal direction of the needle beds on a holding rail, which lever rests against the knitwear under pre-tension below the needle beds and which is coupled to a switching arm influencing an electric switching device.

Devices of the type mentioned above are known in which the switching arm of each feeling lever acts on a separate microswitch which is connected via a cable to the control device of the flatbed knitting machine and, when actuated by the switching arm, closes or opens a control circuit. The cables are provided with a plug connector so that feeling levers which are not to be used for the monitoring can be disconnected from the control device. The cable connections have here been found to be very obstructive in the operation of the machine, particularly when reinserting knitwear which has fallen off. Since the cable connections must be kept relatively long because of the adjustability of the support bodies of the feeling levers, the risk also exists there that cables which have been unplugged and not sufficiently secured drop downwards and are picked up by a delivery device or winding-up device for the knitwear.

Feeling levers are also known which are adjustable over the entire length of the needle beds and which are rigidly coupled to a switching arm which, in the response position of the feeling lever, can come to rest against a conductor rod, which is bare but mounted insulated and which is common to all feeling levers, and thus close a control circuit. Although the cable connections are omitted in this design, problems occur with feeling levers which are not intended to be used for monitoring. Such feeling levers must be either completely removed or displaced into special parking areas in which the conductor rod is insulated so that the switching arms of the feeling levers placed out of operation cannot form a contact bridge. This adjusting of the feeling lever support bodies arranged below the needle beds represents an annoying additional operation in an area of the machine which cannot be easily subjected to a visual check.

The invention is based on the object of developing a device of the type initially mentioned in such a manner that separate switching-off or adjusting of feeling levers which are not intended to be used for monitoring can be dispensed with.

According to the invention, the object set is achieved in the said device by the fact that the switching arm is constructed as a contactless contactor which is arranged to be movable through a contact range of the electric switching device into an ineffective end position with a response movement of the feeling lever.

Thus, the device according to the invention has the advantage that a feeling lever can trigger a switching pulse, that is to say close or open a control circuit, with its switching arm only during its response movement, but no longer influences the electric switching device, in its end position which it assumes when the knitwear is missing. Thus, feeling levers exempted from monitoring the knitwear can remain in their response position, do not need to be electrically decoupled and also do not need to be displaced into areas which are ineffective for control. There are no cable connections to the support bodies of the feeling levers.

The contact range of the electric switching device can be advantageously formed by a light barrier (infrared light barrier) or ultrasonic barrier, which is common to several feeling levers, through which the switching arm of a monitoring feeling lever moves when the knitwear falls off and quells a short-term interruption of the contact barrier which is sufficient for triggering a control signal. However, feeling levers with individual switching devices can also be used, in which each feeling lever support body is provided, for example, with a Hall generator which can be influenced during the contactless passage of the switching arm and which can be connected via slip contacts to conductor tracks formed on the holding rail so that here, too, there is no cable connection to the individual feeling lever support bodies.

The switching arm can be suitably drive-coupled to the feeling lever with transmission of movement in such a manner that the switching arm executes a longer distance of movement than the feeling lever. In a preferred embodiment, the switching arm is constructed as a two-armed tilting lever, supported on the adjustable support body, having arms of different lengths, the short arm of which is engaged by the feeling lever and the end area of the long arm of which forms the contactor which can be moved through the contact range of the associated switching device. In this arrangement, the feeling lever is suitably under spring tension against the knitwear and the switching arm is suitably under spring tension in the direction of its ineffective end position.

In the text which follows, an illustrative embodiment of a monitoring device constructed in accordance with the invention is explained in greater detail with reference to the attached drawing, in which.

Figure 1:
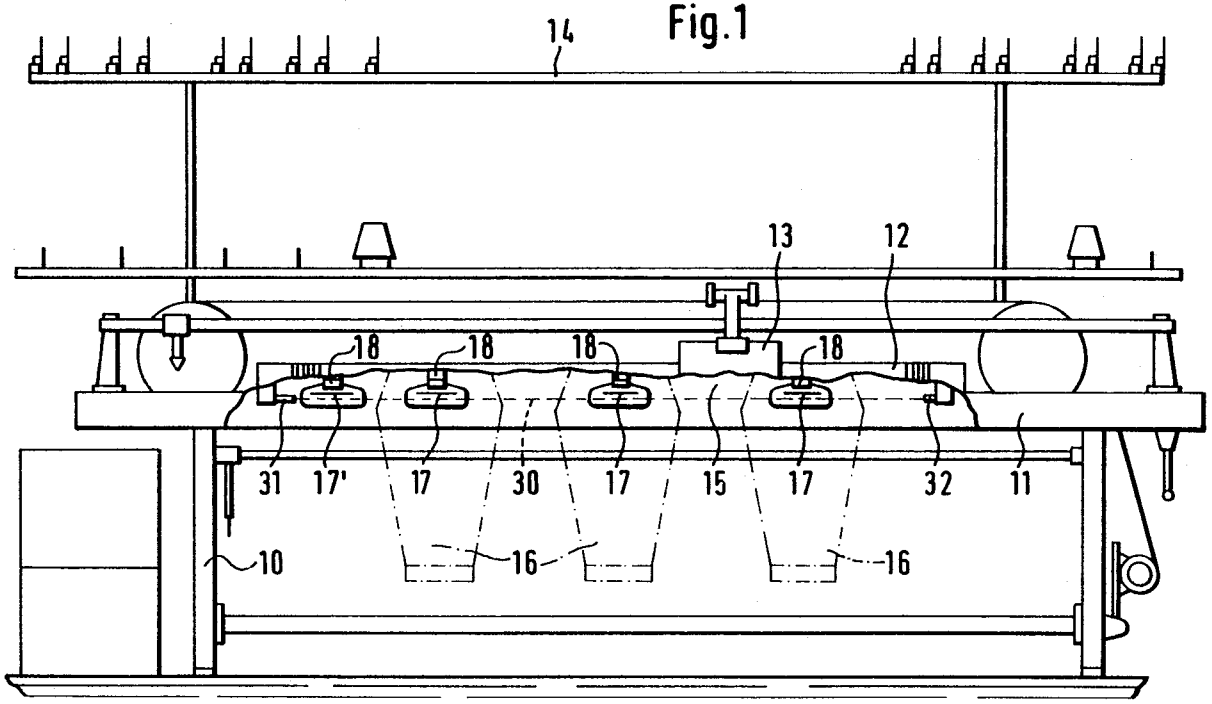
FIG. 1 shows a diagrammatic front view of a flatbed knitting machine with the front needle bed partially removed and having several monitoring elements arranged below this needle bed.

FIG. 1 is a diagrammatic representation of the front view of a two-bed flatbed knitting machine with a machine frame 10, a carrier 11 for the front needle bed 12, a machine slide 13 and a spool rack 14 placed on top. The carrier 11 and the front needle bed 12 are partially removed so that the gap-shaped knitwear delivery area 15, located below the two needle beds, can be seen, in which a device for monitoring the knitwear or knitwears 16 is arranged.

Figure 2:
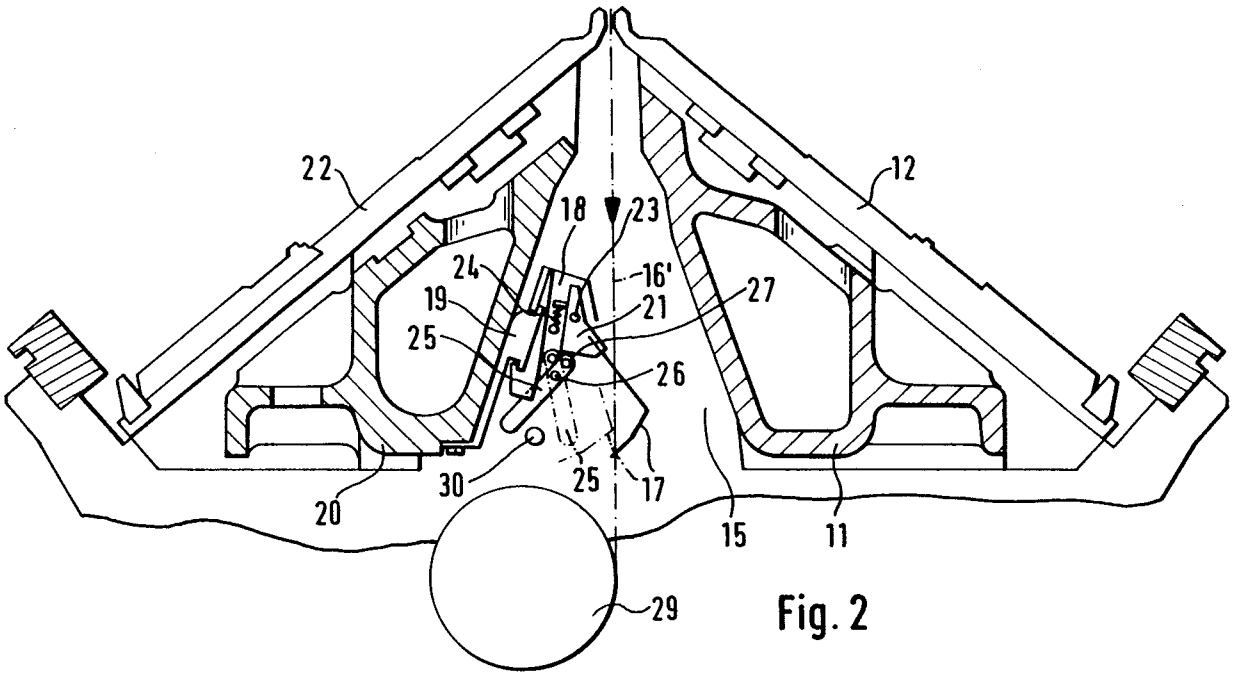
FIG. 2 shows a cross-section through the needle beds of the knitting machine on a scale which is enlarged with respect to FIG. 1, and in the case of a flatbed knitting machine provided with a knitwear delivery device.

The monitoring device exhibits several wide feeling levers 17 which are in each case arranged on a support body 18 which, according to FIG. 2, is arranged displaceably on a holding rail 19 which is attached to a carrier 20 for the lower needle bed 22 and extends over the entire length of the two needle beds 12 and 22. According to FIG. 2, the feeling lever 17 is inserted in a holder 21 which is supported to be rotatable around an axis 23 on the support body 18 and which is under pre-tension of a tension spring 24.

In addition, a switching arm 25 is supported to be rotatable around an axis 26 on the support body 18, which arm is pivoted with a short arm at a point 27 on the holder 21 and which forms a contactless contactor with a long arm.

The feeling lever 17 and the switching arm 25 are drawn with continuous lines in their position which they assume when the feeling lever does not rest against a length of knitwear 16' and in which the feeling lever 17, and thus also the switching arm 25, are pre-tensioned by the tension spring 24. The feeling lever 17 is drawn with dot-dashed lines in a position which it assumes when resting against a length of knitwear 16 which is conducted to a delivery roller 29. In this monitoring position of the feeling lever 17, the switching arm 25 assumes the position also drawn with dot-dashed lines in FIG. 2. In the angular range limited by the two positions of the switching arm 25 drawn, an infrared light barrier 30 extends between a light transmitter 31, drawn in FIG. 1, and a light receiver 32. This infrared light barrier 30 forms the contact range of a switching device, not shown in greater detail, of a control device of the flatbed knitting machine. During the adjusting movement of the switching arm 25 from its one end position into the other and vice versa, the light barrier is interrupted for a brief time, but is not influenced in the end positions of the switching arm 25, even in its end position drawn with continuous lines which it assumes with the feeling lever 17 unloaded. This ineffective end position is assumed, for example, by switching lever 25 of the feeling lever 17', drawn fully on the left in FIG. 1, which is arranged in a needle area free of knitwear.

The monitoring elements constructed in accordance with the invention with their feeling lever 17 and a switching arm 25 constructed as a contactless contactor can also be coupled to individual switching devices which can consist of a Hall generator which is arranged in the support body and which can be influenced by the switching arm 25 during its adjusting movement an which can be coupled via slip contacts to electric contact tracks of the control device which are formed on the holding rail 19.

We claim:

1. Device for flatbed knitting machines for monitoring the knitwear for falling-off, having at least one feeling lever which is supported on a support body adjustable in the longitudinal direction of the needle beds on a holding rail, which lever rests against the knitwear under pre-tension below the needle beds and which is coupled to a switching arm influencing an electric switching device, characterized in that the switching arm (25) is constructed as a contactless contactor which is arranged to be movable through a contact range of the electric switching device into an ineffective end position with a response movement of the feeling lever (17).

2. Device according to claim 1, characterized in that the contact range of the switching device is formed by a light barrier (30) or ultrasonic barrier which is common to several feeling levers (17).

3. Device according to claim 1, characterized in that each support body (18) of a feeling lever (17) is provided with a Hall generator which can be influenced when the switching arm (25) passes and which is connected via slip contacts to conductor tracks formed on the holding rail (19).

4. Device according to claim 1 characterized in that the switching arm (25) is drive-coupled to the feeling lever (17) with transmission of movement in such a manner that the switching arm (25) executes a longer distance of movement than the feeling lever (17).

5. Device according to claim 1 characterized in that the switching arm (25) is constructed as a two-armed tilting lever, supported on the adjustable support body (18), having arms of different lengths, the short arm of which is engaged by the feeling lever (17) and the end area of the long arm of which forms the contactor which can be moved through the contact range of the associated switching device.

6. Device according to one of claim 1 characterized in that the feeling lever (17) is under spring tension against the knitwear (16, 16') and the switching arm (25) is under spring tension in the direction of its ineffective end position (tension springs 24).

7. Device according to one of claim 2 characterized in that the light barrier, particularly the infrared light barrier (30) or ultrasonic light barrier extends parallel to the holding rail (19) over the entire length of a needle bed (12, 22).

* * * * *